US005141389A

United States Patent [19]

Bear et al.

[11] Patent Number: 5,141,389

[45] Date of Patent: Aug. 25, 1992

[54] CONTROL SYSTEM FOR REGULATING THE AXIAL LOADING OF A ROTOR OF A FLUID MACHINE

[75] Inventors: Clayton Bear; Timothy A. Harris, both of Calgary, Canada

[73] Assignee: NOVA Corporation of Alberta, Calgary, Canada

[21] Appl. No.: 495,920

[22] Filed: Mar. 20, 1990

[51] Int. Cl.[5] ..... F01D 17/06

[52] U.S. Cl. ..... 415/30; 415/47; 415/105; 415/107; 415/112; 415/81; 277/3; 277/15; 277/72 R; 277/74

[58] Field of Search ..... 415/104, 105, 107, 110, 415/112, 47-49, 17, 30; 277/3, 15, 65, 71, 72 R, 74, 79, 81 R

[56] References Cited

U.S. PATENT DOCUMENTS

| | | | |
|---|---|---|---|
| 3,236,499 | 2/1966 | Chatfield et al. | 415/110 |
| 4,309,144 | 1/1982 | Eggmann et al. | 415/107 |
| 4,413,946 | 11/1983 | Marshall et al. . | |
| 4,472,107 | 9/1984 | Chang et al. . | |
| 4,578,018 | 3/1986 | Pope . | |
| 4,993,917 | 2/1991 | Kulle et al. | 415/112 |
| 5,028,204 | 7/1991 | Kulle et al. | 415/112 |

FOREIGN PATENT DOCUMENTS

| | | | |
|---|---|---|---|
| 0469815 | 8/1975 | U.S.S.R. | 415/107 |
| 1435838 | 11/1988 | U.S.S.R. | 415/107 |

*Primary Examiner*—Edward K. Look
*Assistant Examiner*—Christopher M. Verdier
*Attorney, Agent, or Firm*—Stevens, Davis, Miller & Mosher

[57] ABSTRACT

The axial forces imposed on a rotor of a fluid machine such as a compressor is controlled by modulating the pressure supplied to a piston and cylinder device acting between the rotor shaft and housing. A parameter indicative of axial force on the rotor during operation is monitored and changes in the magnitude and direction of the axial forces countered by varying the pressure in the cylinder. The net axial forces imposed on the shaft may thus be controlled in a predetermined range.

14 Claims, 7 Drawing Sheets

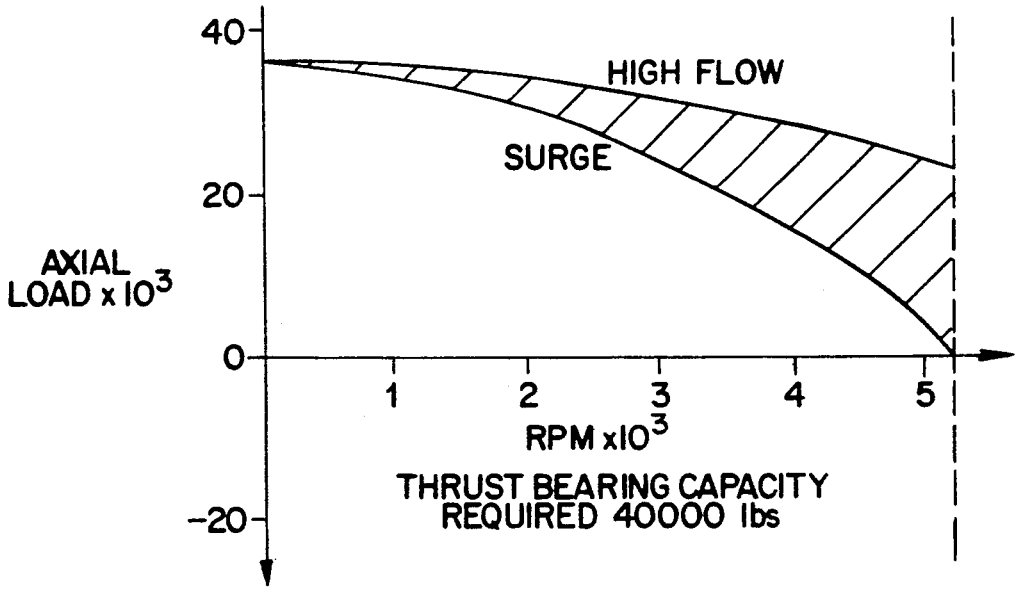
Fig. 4a PREDICTED AXIAL LOAD VS. SPEED WITHOUT THRUST REDUCER
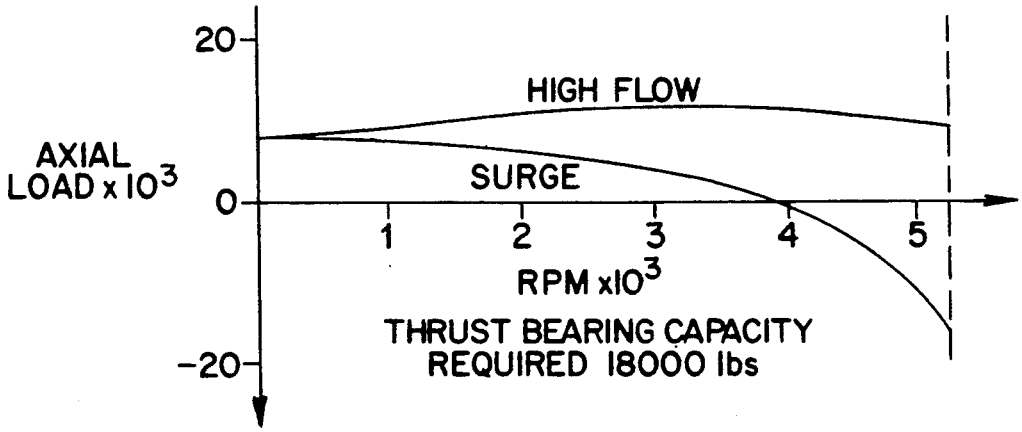
Fig. 4b AXIAL LOAD VS. SPEED-VARIABLE BACKPRESSURE ON THUST REDUCER
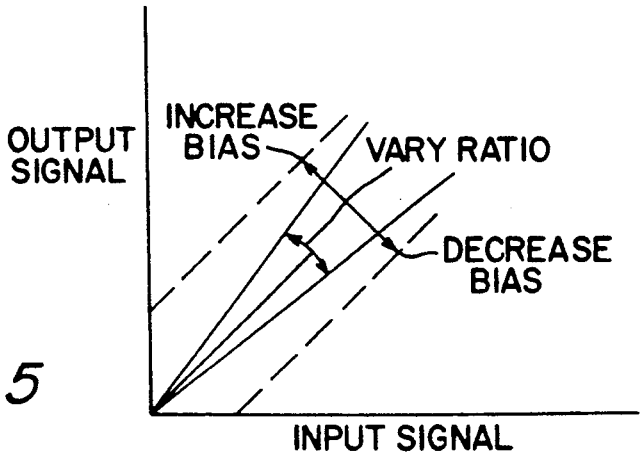
Fig. 5

CONTROL SYSTEM FOR REGULATING THE AXIAL LOADING OF A ROTOR OF A FLUID MACHINE

The present invention relates to rotating fluid machines and in particular to control systems for controlling the axial loads imposed on the rotor of the machine during operation.

Rotating fluid machines are used in a variety of applications to transfer energy between a fluid and a rotating mechanical system. Such machines include compressors which compress a gas in a continuous manner, pumps for pumping liquids and turbines for deriving useful work from a fluid flow. The machines usually have a housing with a fluid duct extending through the housing and one or more rotors rotating within the duct. The rotors rotate at a speed sufficient to cause a pressure differential between the inlet and outlet of the duct.

The rotors include an impeller mounted on a shaft which is, in turn, supported in the housing on bearing assemblies. Because of the high rotational speeds and close tolerances encountered within certain classes of machines, typically compressors, high demands are placed upon the bearing assemblies. Such assemblies tend to be expensive and of course must be designed to withstand the maximum load that may be applied for extended periods. This in turn increases the cost of the bearings.

Conventional hydrodynamic and antifriction bearings incur significant parasitic losses and during start-up the static friction in the bearings may be sufficient to prevent rotation of the rotor assembly subjecting it to adverse conditions.

Magnetic bearings are utilized in some applications to support the shaft for rotation and also to oppose axial loads on the shaft. Magnetic bearings avoid the limitations encountered in hydrodynamic and antifriction bearings, particularly at high speed, and, through control systems, permit dynamic adjustment of the bearings to maintain the shaft centred. However, the specific load capacity of a magnetic bearing is less than that of a mechanical bearing and so a physically larger bearing is required to withstand the loads typically encountered in a gas compressor. Moreover, where magnetic bearings are used, the typical loads imposed on the bearings result in a relatively large bearing assembly.

The loads imposed on the rotor of the compressor are caused in part by the pressure differential across the machine and also by the mass flow through the machine. Attempts have been made to reduce the axial loads caused by the pressure differential by utilizing a balance piston having one surface exposed to the high discharge pressure and the other surface exposed to the inlet or suction pressure. However, leakage occurs across the balance piston which may represent a substantial loss in machine efficiency. Moreover, the pressure differential and the momentum forces vary with different operating conditions of the machine so that a considerable axial force can still be generated during operation of the machine which must be accomodated by the bearings.

It is therefore an object of the present invention to provide a control system which obviates or mitigates the above disadvantages and permits control of the axial forces imposed on the rotor of the machine.

According to the present invention, there is provided a rotating fluid machine having a housing, a fluid duct extending through the housing, a rotor rotatably supported in the housing to be impinged by fluid flowing through the duct, a cylinder formed in the housing and located to receive a piston carried by said rotor, fluid supply means to supply fluid to said cylinder and control means to control the pressure of fluid in said cylinder, said control means being responsive to changes in axial forces imposed on said rotor to maintain said forces within a predetermined range.

By controlling the pressure of fluid in the cylinder, the axial forces imposed on the rotor may also be controlled so that the net force is maintained within a predetermined range. This reduces the maximum design load that has to be accomodated and thereby permits a reduction in the size of bearings utilized.

Preferably the control means includes a sensor responsive to a parameter that is indicative of the axial loads applied to the rotor. This parameter may include the speed of the rotor, or the pressure differential across the rotor.

Embodiments of the invention will now be described by way of example only with reference to the accompanying drawings in which FIG. 1 is a sectional view through an overhung compressor;

FIG. 4 is a graphical representation of the relationship between thrust and speed of the compressor shown in FIG. 1, the curve of FIG. 4*a* showing the relationship without compensation and the curve of FIG. 4*b* showing the relationship with compensation;

FIG. 5 is a graphical representation of the control signal modification obtained through the use of the control system shown in FIG. 3;

Figure 1:
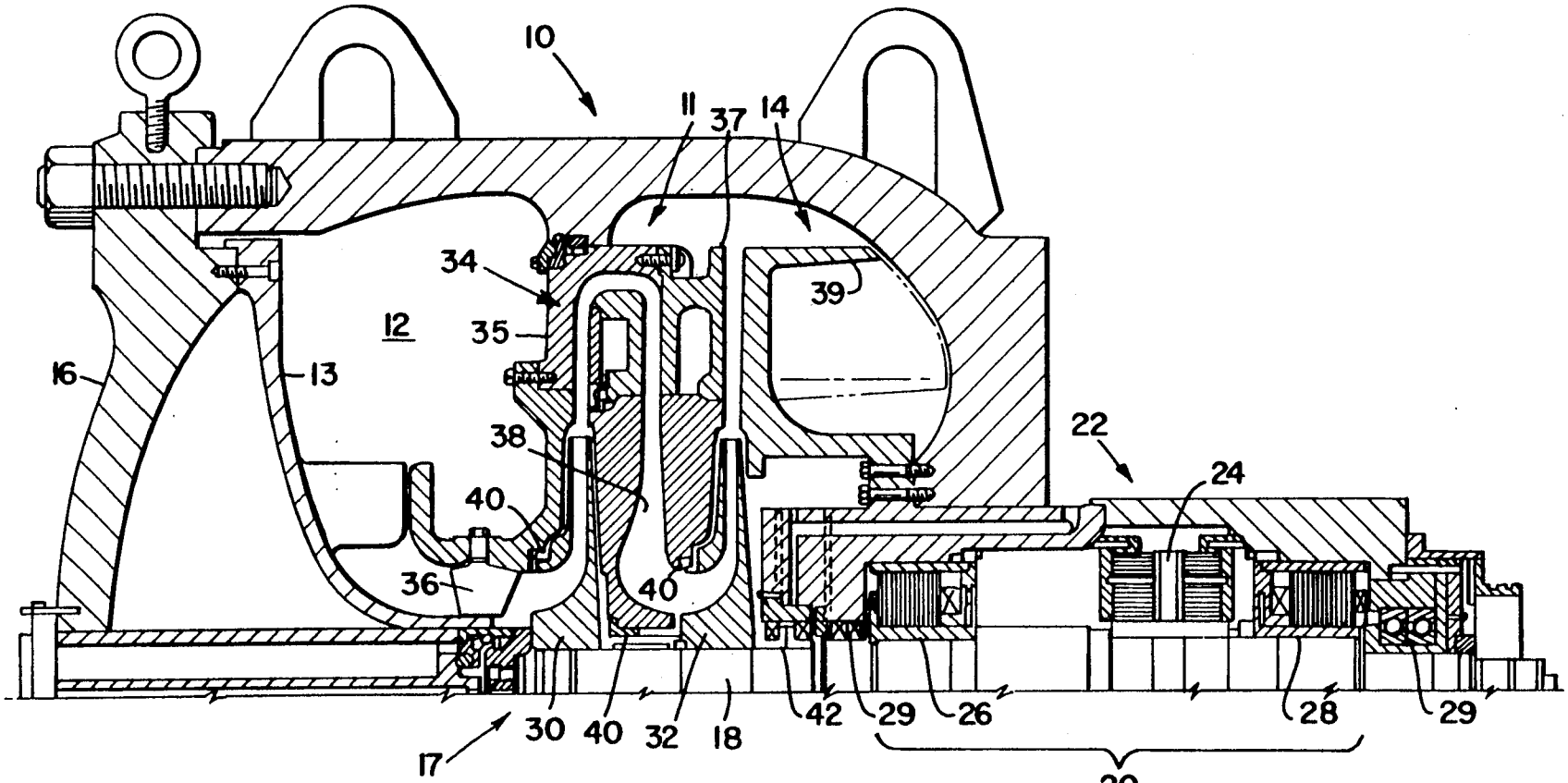

Referring therefore to FIG. 1, a rotary fluid machine, in this embodiment, a compressor has a housing 10 with a fluid duct indicated generally at 11 extending between an inlet volute 12 and an outlet volute 14. The forward end of inlet volute 12 is defined by a wall 13 (commonly referred to as 'scoop') secured to a door 16 that closes the forward end of the housing 10.

A rotor assembly 17 including a shaft 18 is rotatably supported within the housing 10 by a bearing assembly 20. The bearing assembly 20 includes a bearing housing 22 having a magnetic thrust bearing 24 and a pair of magnetic radial bearings 26,28 spaced apart on either side of the thrust bearing 22. The magnetic bearings 24,26,28 are of conventional nature and will not be described in further detail. Conventional antifriction bearings 29 are also provided at spaced locations on the shaft 18 to provide emergency support for the shaft 18 in the event that the magnetic bearings fail.

The rotor assembly 17 further includes a pair of impellers 30,32 located at the forward end of shaft 18 that rotate with the shaft 18. Flow from the inlet volute 12 past the impellers 30,32 to the outlet volute 14 is controlled by a diaphragm assembly 34 comprising an inlet diaphragm 35, an interstage diaphragm 37 and a rear diaphragm 39. The assembly 34 is secured within the casing 10 and inlet vanes 36 direct gas to the first of the impellers 30. An internal passageway 38 directs gas from the discharge of the first impeller 30 to the inlet of the second impeller 32 with labyrinth seals 40 positioned between the rotor assembly 17 and the seal between the shaft 18 and the diaphragm assembly 34. A dry gas seal assembly 42 is located between the impeller 32 and the bearing housing 22 to seal between the discharge and the shaft 18.

Figure 2:
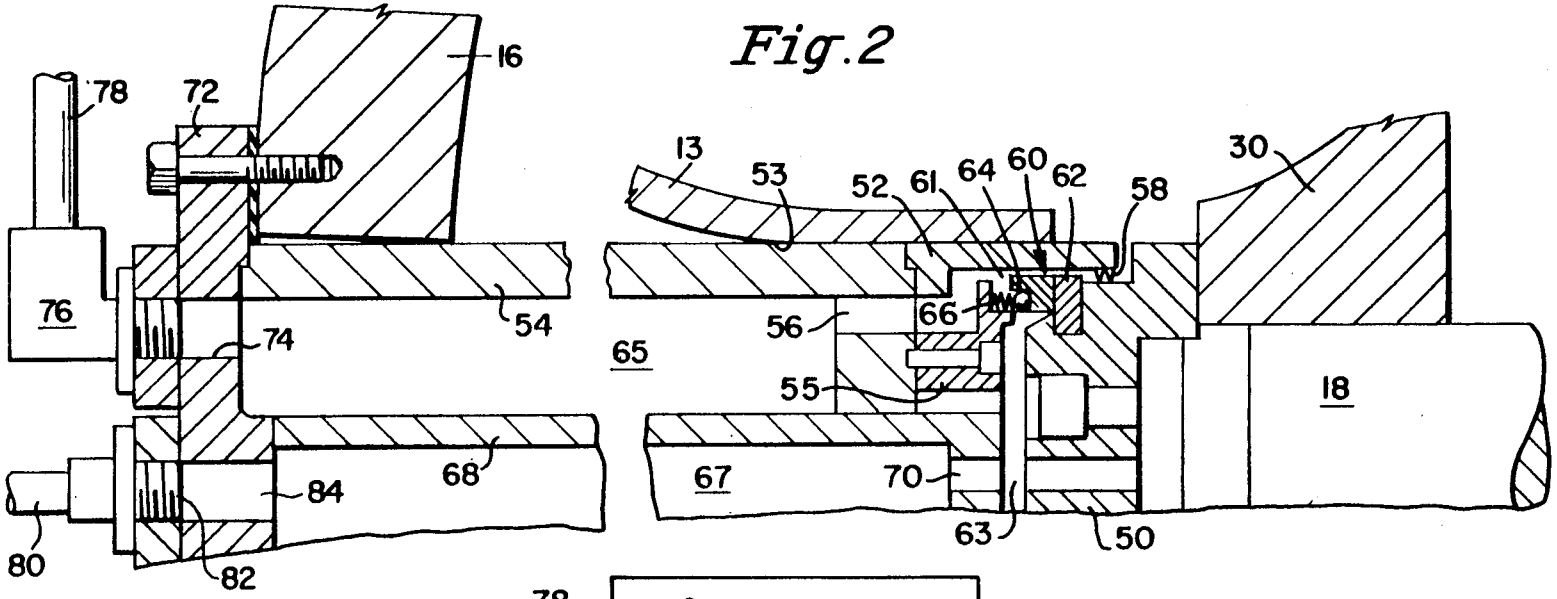
FIG. 2 is a view of a portion of FIG. 1 on an enlarged scale.

As can best be seen in FIG. 2, the impeller 30 is located on shaft 18 by a retainer which is also formed as a piston assembly 50. Piston assembly 50 is received within a cylinder 52 located in a cylindrical bore 53 formed at the radially inner extremity of the scoop 13. An elongate tube 54 extends from the bore 53 to the door 16. The cylinder 52 is closed by an end wall 55 and a labyrinth seal assembly 58 acts between the flank of the piston 50 and the wall of the cylinder 52 to restrict the flow of gas out of the cylinder 52.

A dry gas seal assembly 60 is located radially inwardly of the labyrinth seal assembly 58 and acts between the end wall 55 of the cylinder 52 and the nose of the piston 50. The seal assembly 60 therefore divides the cylinder 52 into an outer annular chamber 61 and an inner cylindrical chamber 63 with flow between being controlled by the seal assembly 60. The seal assembly 60 is of the dry gas seal type having a mating ring 62 carried by the piston and a primary seal ring 64 carried by the cylinder 52 and biased toward the mating ring 62 by means of springs 66.

A central tube 68 is located within the tube 54 and extends from the door 16 to the end wall of the cylinder 52 to define inlet and outlet chambers 65, 67 respectively. A passage 56 is formed in the end wall 55 to connect the inlet chamber 65 with outer annular chamber 61. An internal passage 70 also extends through end wall 55 and permits communication between the inner chamber 63 of the cylinder 52 and outlet chamber 67.

The outer end of tubes 54 and 68 is sealed by means of a flange 72 that is secured to the door 16. The flange 72 includes a radial offset bore 74 that receives a coupling 76 secured to a supply line 78. The line 78 carries filtered gas from the discharge duct 14 (FIG. 1) and introduces it to the inlet chamber 65 and through passages 56 to the annular outer chamber 61. A control line 80 is connected by means of a union 82 to a central bore 84 to permit gas to be vented from the inner chamber 63 through the passage 70 and outlet chamber 67.

Figure 3:
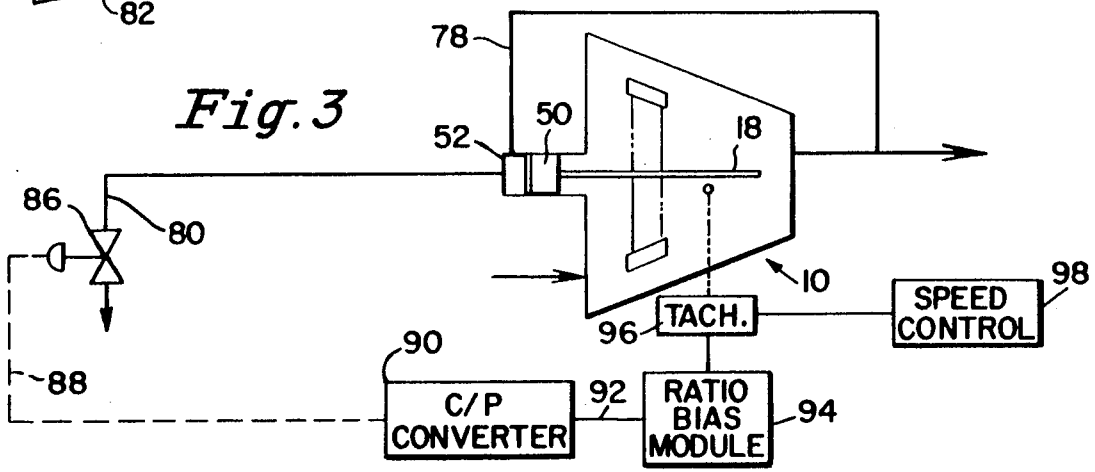
FIG. 3 is a schematic representation of the control circuit utilized to control the loads imposed on the rotor of the compressor of FIG. 1.

To control the axial forces imposed on the rotor, the pressure in the cylinder 52 is regulated by the control scheme shown in FIG. 3.

As can best be seen in FIG. 3, the control line 80 is connected to a pressure control valve 86 that vents gas flowing through the control line 80 to a suitable vent. The pressure control valve 86 is controlled by a pilot pressure line 88 so that the pressure maintained in line 80 of the valve 86 is set by the pressure in the line 88. The pressure in line 88 is derived from a signal fed to a current-to-pressure converter 90 through signal line 92 that is itself connected to a ratio bias module 94. The ratio bias module receives a control signal from a tachometer 96 that senses the rotational speed of the shaft 18 in conventional manner. The tachometer 96 is also used to operate the speed control system indicated at 98 associated with the machine 10.

As may be seen from FIG. 4*a*, it has now been recognized that the net axial force imposed on the shaft 18 varies with output speed with maximum load occurring at low speed, i.e. start up conditions. The curve shown in FIG. 4*a* shows the estimated variation of load with speed for a typical overhung compressor operating with a suction pressure of 875 psig. As indicated in FIG. 4*a*, a change in compressor speed is accompanied by a change in axial load.

To reduce the net axial forces, the control arrangement shown in FIG. 3 is used to vary the pressure in the chamber 63 in cylinder 52 as the rotational speed of the shaft 18 varies. As will be apparent from a consideration of the configuration of the piston 50 and cylinder 52, the inner chamber 63 provides a surface area that may be used to generate an axial force along the shaft 18. By varying the pressure of gas in the inner chamber 63, the axial force exerted on the shaft 18 may also be varied. By correlating the pressure in the chamber 63 to the rotational speed of the shaft 18, an appropriate axial force may be imposed on the shaft 18 to counteract the inherent axial forces generated by operation of the machine. This maintains the net axial force on the shaft 18 within a predetermined range over the range of normal operating speeds. The effect of this is shown in FIG. 4*b* where a control pressure in chamber 63 is varied linearly from 0 to 300 psig as the speed increases from 0 to 5000 rpm. As may be seen in FIG. 4*b*, the axial load encountered was reduced to 18,000 lbs from 40,000 lbs at start up and for high flow operation remained substantially constant over the speed range.

In operation therefore, the rotor assembly 18 is rotated by a suitable drive means and gas supplied to the inlet 12 is compressed and discharged through the outlet route 14. A small flow of the discharge gas is fed through line 78 after being filtered and introduced into the annular chamber 61 through the passage 56. The labyrinth assembly seal 58 maintains gas within the outer annular chamber 61 but any gas that does escape is introduced immediately into the inlet volute 12 for recompression.

The dry gas seal assembly 60 functions by permitting a controlled but very small amount of gas to flow between the relatively moving surfaces of the mating ring 62 and primary seal 64. Thus a small amount of gas from the chamber 61 flows into the chamber 63 where its pressure is applied across the end face of the piston 50. The pressure in chamber 63 is controlled by the valve 86 to be maintained at the required level.

Rotation of the rotor assembly 17 also generates a signal from the tachometer 96 which is applied to the ratio bias module 94. The ratio bias module as seen in FIG. 5 may provide varying gains and varying offsets so that the desired output relationship to the input may be obtained. The input signal to the module 94 therefore produces the desired output signal in line 92 and sets the converter 90 at the required control pressure in line 88 to produce the desired pressure in control line 80.

As the speed of the compressor increases, the discharge pressure in volute 14 and the mass flow acting on the impellers 30,32 increase. The mass flow my also vary depending upon the inlet and outlet conditions. The net effect typically is an increase in the axial thrust in the direction of the inlet volute due to increased pressure at the discharge volute 14. This may be offset in part by an increase in momentum forces. The pressure in the inner chamber 63 is also increased and an increased force acts through piston 50 toward the discharge volute 14. In this way, the net axial forces imposed on the thrust bearing assembly 24 are reduced, allowing for a smaller bearing assembly.

The use of the ratio bias module 94 is particularly convenient for different installations. The gain may be adjusted to match the gradient of the speed thrust curve and the bias may be utilized to obtain a initial offset to suit either the characteristics of the control valve 86 or those of the magnetic bearing. For example, by decreasing the bias so that it intersects the ordinate, the pressure in the control line 80 will remain at 0 until some speed higher than 0 rpm. Thereafter, there will be a uniform increase in pressure as the speed increases. This effect may be desirable where a certain range of forces can be accomodated in the magnetic bearing 24 and it is desirable to operate within the midpoint of that range.

Similarly, by increasing the bias so that it intercepts the abscissae, a positive pressure would be generated even at 0 rpm to produce a preload on the shaft 18, which is useful during start up. In this case, a separate pressurized gas supply would be provided to the line 78 to provide the initial preload.

It will be seen, therefore, that by monitoring the speed of the compressor shaft 18 and utilizing that signal as an indication of end thrust, it is possible to reduce the variations in thrust forces imposed on the shaft 18 in a progressive and controlled manner.

Figure 6:
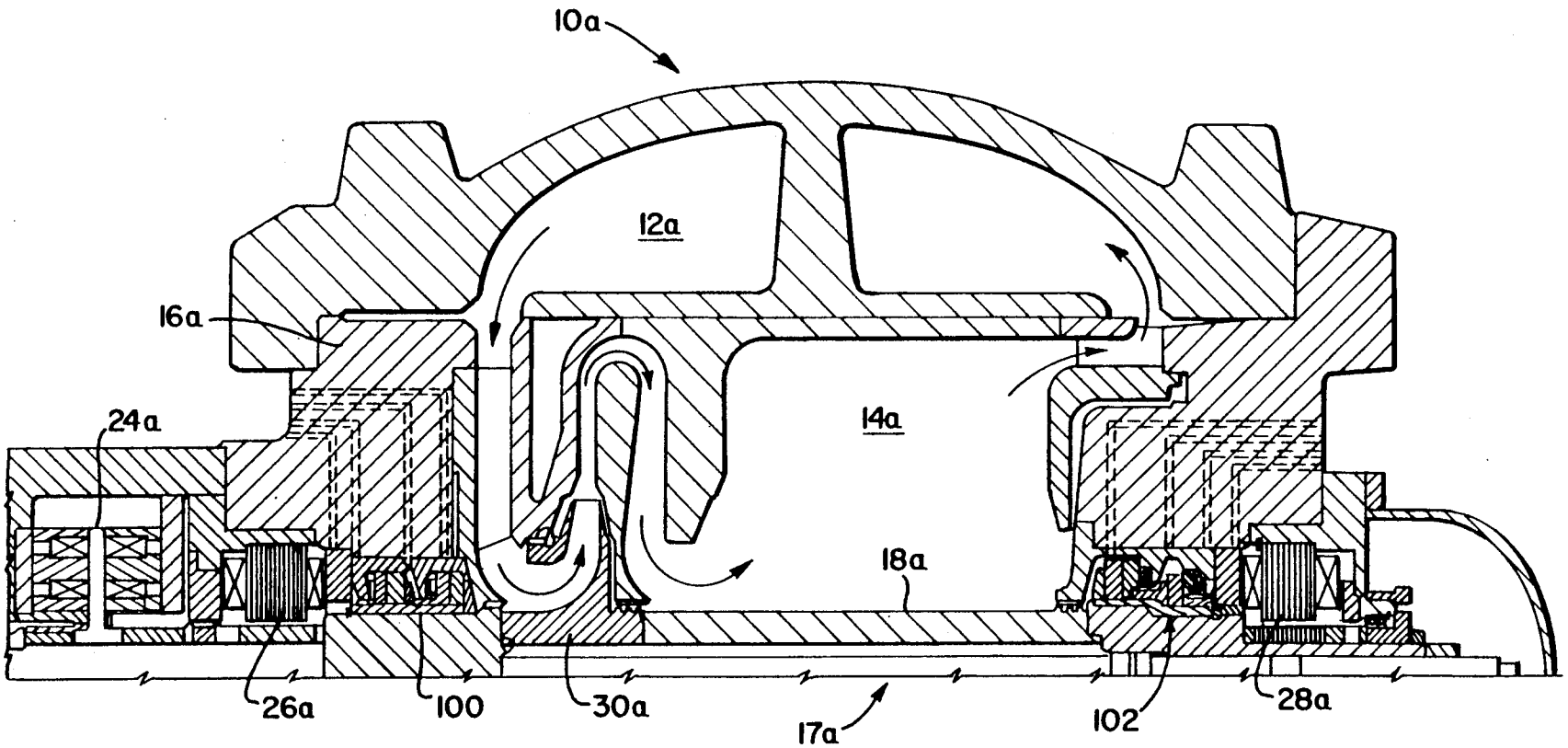
FIG. 6 is a sectional view similar to figure 1 of a beam compressor.
Figure 7:
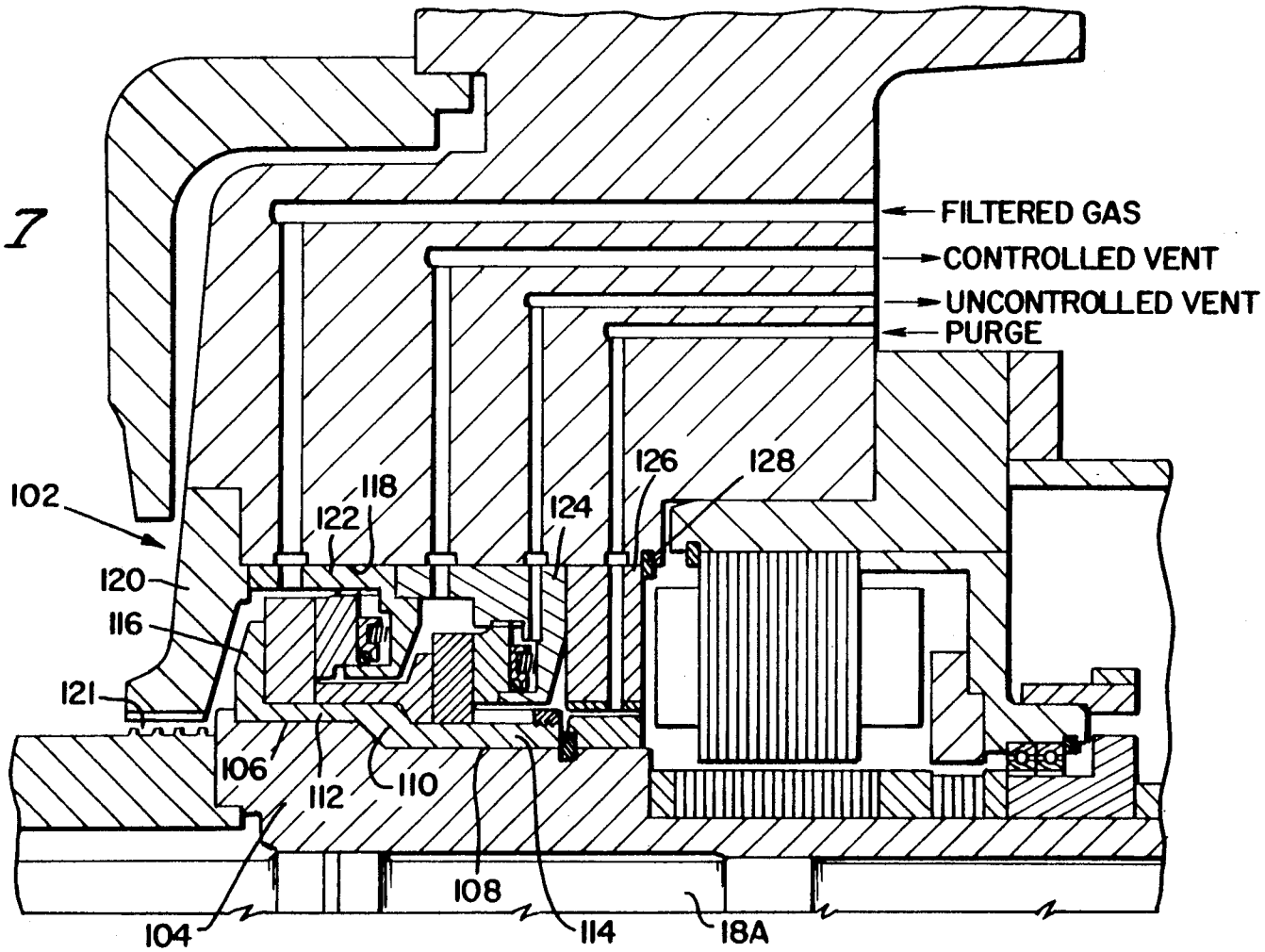
FIG. 7 is a view of a portion of the compressor shown in FIG. 6 on an enlarged scale.
Figure 8:
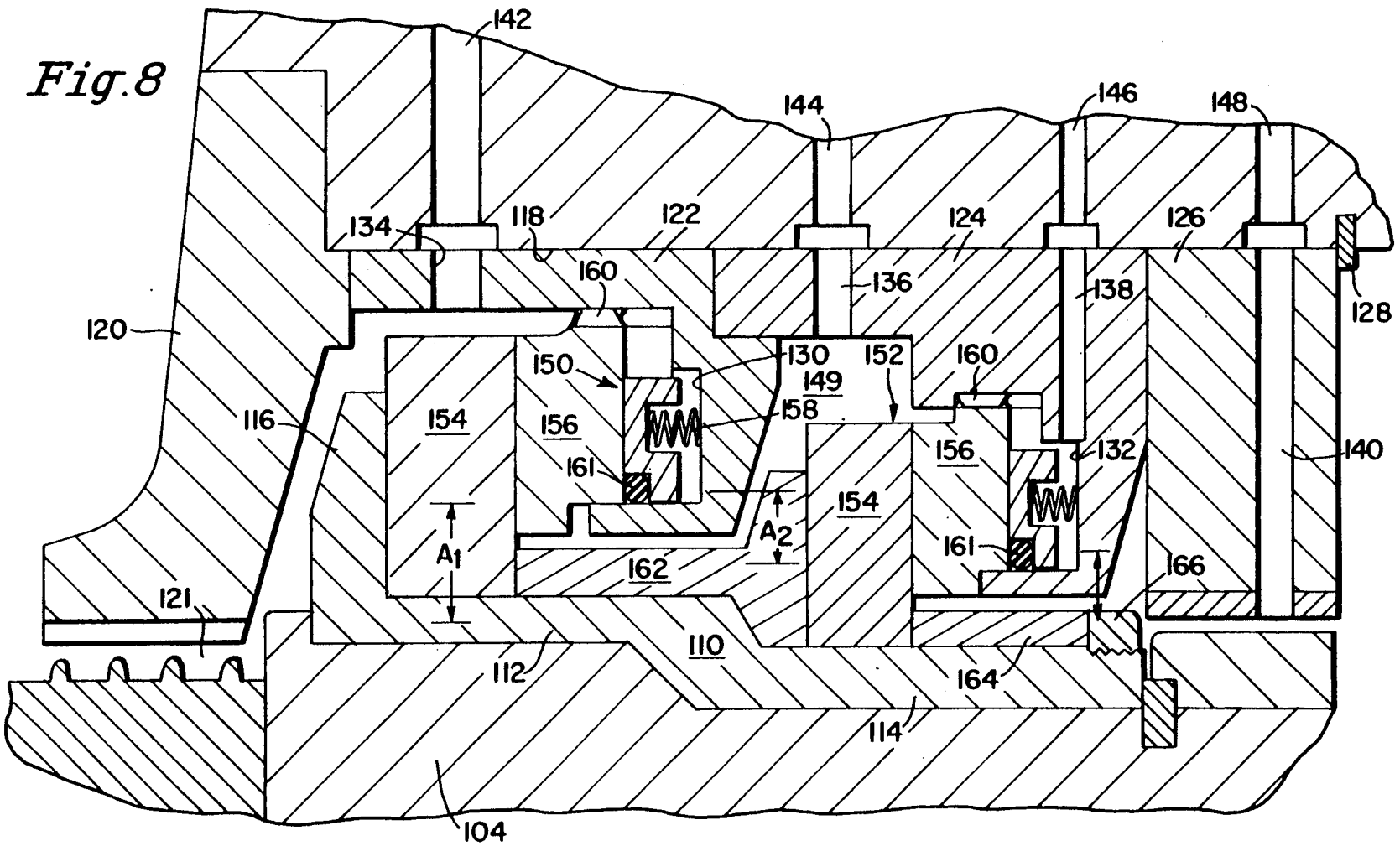
FIG. 8 is a simplified view of a portion of the seal arrangement shown in FIG. 7 but on an enlarged scale.

An alternative form of compressor known as a beam type is shown in FIGS. 6, 7 and 8 in which the shaft 18*a* is supported at laterally spaced locations. The operation of the compressor shown in FIGS. 6—8 is substantially similar in many respects to that of the overhung compressor shown in FIGS. 1 and 2 and therefore like reference numerals will be utilized to describe like components with a suffix 'a' added for clarity. In the compressor shown in FIGS. 6–8, gas from the inlet volute 12*a* passes through rotor assembly 17*a* and into the discharge duct 14*a*. Of course, additional impellers 30*a* may be mounted upon the shaft 18*a* to provide multiple stages of compression if desired.

The shaft 18*a* is supported at spaced locations by radial magnetic bearings 26*a* and 28*a* respectively and axial forces are accomodated by a magnetic thrust bearing 24*a* at the forward end of the compressor. The bearings 24*a* and 26*a* are mounted outboard of an end 16*a* that closes the inlet volute 12*a* and utilizes a dry gas seal assembly 100 to prevent the flow of gas between the door 16*a* and the shaft 18*a*.

Control over axial loading of the shaft 18*a* is provided by a step seal assembly 102 shown in more detail in FIGS. 7 and 8. A sleeve 104 is mounted on the shaft 18*a* and has a stepped outer surface with a pair of cylindrical lands 106,108 respectively. A collar 110 is mounted on the sleeve 104 and is of complementary shape to the lands 106,108. The collar 110 has a pair of cylindrical surfaces 112,114 at different diameters and a radially extending flange 116 that projects towards the inner wall of a stepped bore 118 formed in the end wall of the housing 10*a*. The inner end of the bore 118 is closed by a plate 120 that extends radially inwardly toward the shaft 18*a* and co-operates with a labyrinth seal 121 formed on the shaft. A pair of seal carriers 122,124 are received in the bore 118 and are retained by means of a labyrinth seal body 126 and a circlip 128. Each of the carriers 122,124 has an annular support surface 130,132 respectively to provide support for a seal member in a manner to be described.

A cavity 149 is formed between the seal carriers and the collar 110 and a pair of dry gas seals 150,152 are located in the cavity. Each seal is of well-known construction and includes a mating ring 154 carried by the collar 110 and a primary sealing ring 156 carried by the respective seal carriers 122,124. The primary sealing ring 156 is biased against the mating ring 154 by means of a spring 158 acting against the support surfaces 130,132 with splines 160 inhibiting rotation of the primary seal 156. During relative rotation, pressure balances maintain the seal 156 and ring 154 in close proximity. An O ring 161 seals between the seal 156 and carrier 122,124 at the radially inner edge of the carrier. The mating rings 154 are maintained in spaced relationship by a tubular collar 162 and retained in place against the flange 116 by a spacer 164 and lock nut 166. It will be noted that the mating rings 154 are of different diameters as accomodated by the two cylindrical surfaces 112,114. Each seal 150,152 has a balance diameter at which the pressure drop across the seal is deemed to occur. The balance diameter is nominally at the diameter of O-ring 161 and therefore the difference in the diameter of the O-ring 161 establishes a differential area between the two seals which is used to control the axial forces imposed on the shaft 18*a*.

Each of the seals 150,152 operate by permitting a controlled leakage of gas between the mating ring 154 and stationery ring 156 with a controlled pressure drop across the seal. High pressure gas from the discharge duct 14*a* is filtered and fed through a passage 142 in the housing and passage 134 in the carrier 122 into the area of the seal 150. This gas is essentially at the same or slightly higher pressure as the discharge pressure and the labyrinth seal 121 operates to prevent the unfiltered gas in the discharge duct mixing with the filtered gas adjacent the seal. The seal 150 permits a controlled flow of gas into the cavity located between the seals 150 and 152, and the pressure of gas in that cavity is controlled through passage 136 in carrier 124 and line 144 in housing 10*a*. Gas flowing past the seal 152 is evacuated through passageways 138 and 146 with a purge gas being supplied through passageway 148 and passageway 140 in the seal body 126 to prevent flammable gas passing into the region of the magnetic bearing assembly 28*a*.

As may be appreciated from FIG. 8, the bore 118 defines a cylinder with a piston defined by collar 110 and seals 150,152 located within the cylinder. The discharge pressure $P_D$ generates an axial force proportional to the area $A_1$ exposed to the filtered gas. In the cavity between the seals 152 and 154, this force is opposed by the control pressure $P_C$ acting over an area $A_2$ which is the area resulting from the difference in the balance diameters of the seals 150,152. The discharge pressure $P_D$ is determined by the operating conditions of the compressor and it has now been recognized that by controlling the value of the control pressure $P_C$, the axial loading on the shaft 18 may be controlled as the operating conditions of the compressor vary.

Figure 9:
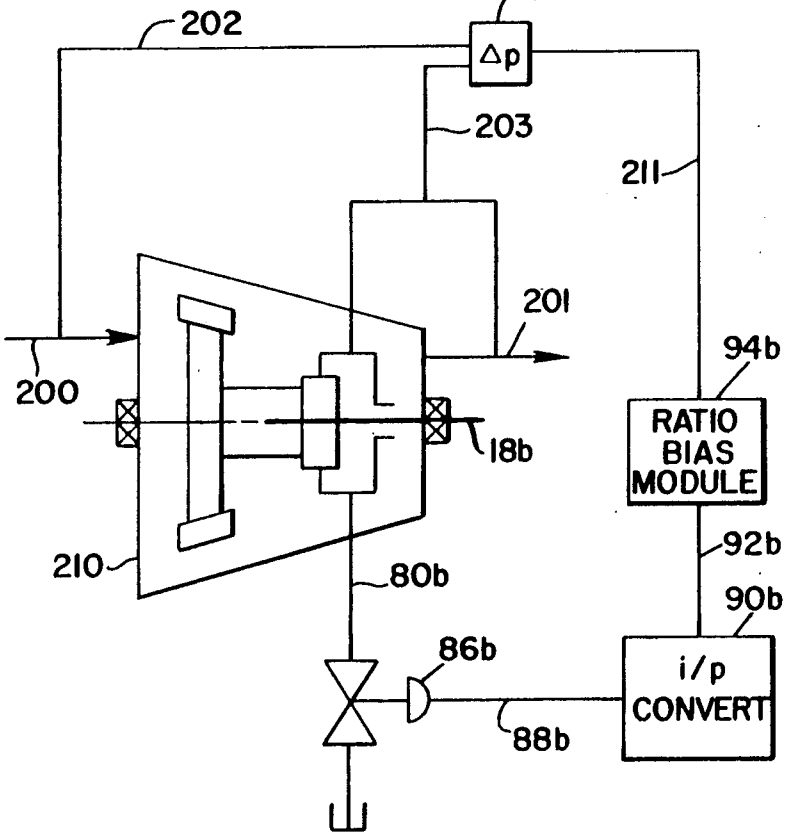
FIG. 9 is a schematic representation of a control system used with the compressor of FIG. 8.

The control arrangement shown schematically on FIG. 9 is an alternative embodiment of the control arrangement shown on FIG. 3 and utilizes several components also shown on FIG. 3. To assist in the understanding of the control arrangements, components common to both control arrangements are identified by the same number with suffix "b" added on FIG. 9.

In this embodiment, the operation of machine 210 imposes a net axial force on shaft 18*b* which varies with the difference in fluid pressure between the fluid inlet 200 and fluid exit 201. Pressure sensing lines 202 and 203 sense the fluid pressure at the fluid inlet and fluid exit respectively. The two pressures are supplied to transducer 172 which provides a signal to signal line 211 in accordance with the difference in fluid pressure. The signal provided by transducer 172 is similar to the signal provided by tachometer 96 shown on FIG. 3, in that both signals are indicative of the axial force imposed on the shaft of the machine (i.e. they are derived from parameters that indicate the axial force, but they are not a direct measurement of the axial force). The signal provided by transducer 172 is supplied to ratio bias module 94*b* where the signal is processed in accordance with gain and offset values. The output signal of the ratio bias module is applied to current/pressure converter 90*b* which in turn sets the control pressure in line 88*b* to produce the desired pressure in control line 80*b*.

In each embodiment, however, it will be recognized that by monitoring a parameter indicative of the varying axial loads on the shaft of the compressor and using this signal to modulate the pressure in an axially-disposed cylinder on the shaft, it is possible to maintain the net axial forces on the shaft within predetermined parameters.

The embodiments of FIGS. 6 and 7 illustrate the stepped seal assembly at the discharge end of the compressor 10*a*. It will be appreciated, however, that the seal assembly 100 could utilize a stepped arrangement to control the net axial forces on the rotor assembly 17*a* with a conventional dry seal assembly utilized at the discharge end of the compressor.

The ability to utilize a pair of stepped seal assemblies provides an enhanced control of the axial forces in certain conditions. As shown in FIG. 4, the force envelope approaches zero at high speed and surge conditions and in certain applications the direction of the load may reverse. In this situation, it may be desirable to reverse the direction of the force applied through the control pressure, and the provision of a pair of stepped seals facilitates this.

Figure 10:
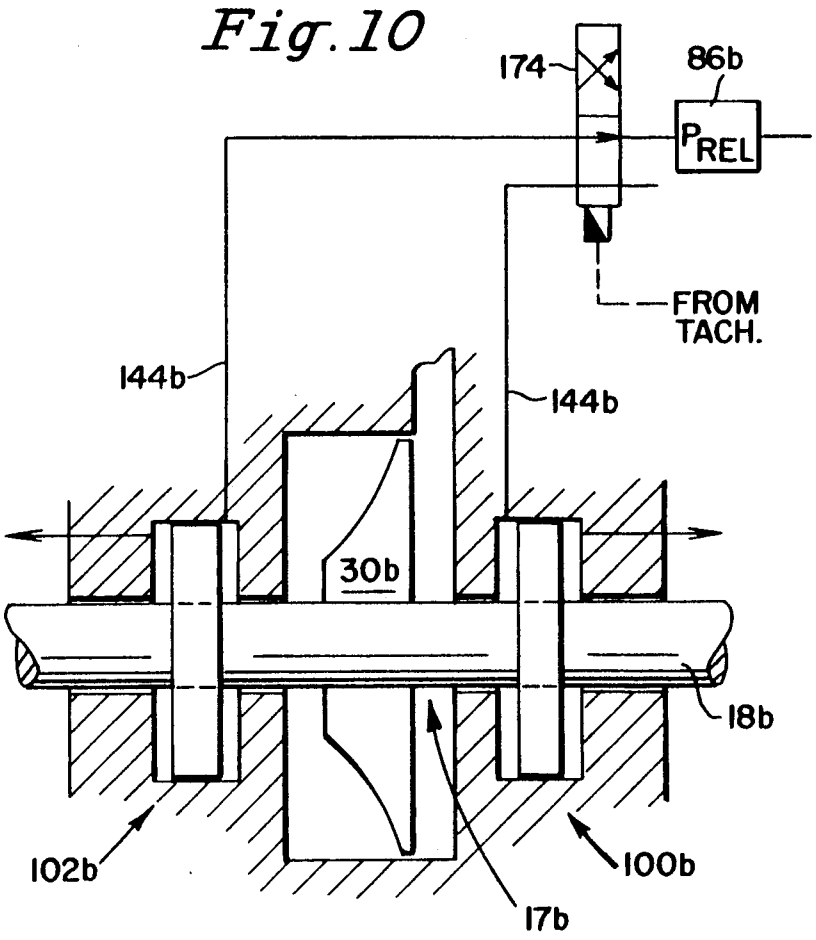
FIG. 10 is a schematic representation of a further arrangement of compressor.

As shown schematically in FIG. 10, where like components to those shown in FIG. 6 are identified by like reference numerals with a suffix 'b' added for clarity, rotor assembly 17*b* is sealed within housing 10*b* by seal assemblies 100*b*,102*b* located on opposite sides of impeller 30*b*. Each of the seal assemblies 100*b*,102*b* is a stepped seal assembly similar in construction to the seal assembly 102 shown in detail in FIGS. 7 and 8 and as such will not be described in further detail. As indicated schematically in FIG. 10 and described in detail with respect to FIG. 8, each of the seal assemblies functions as a piston and cylinder device with the pressure in the cylinder formed between the two seals vented through line 144*b*. Each of the assemblies acts in the opposite direction with seal assembly 100*b* providing a differential area $A_{2b}$ to produce a force in the direction of the outlet duct and the seal 102*b* providing a differential area that produces a force in the direction of the inlet duct.

The control pressure $P_c$ is controlled by the pressure control valve 86*b* through a two position valve 174 that connects the vent duct 144*b* of either seal assembly 100*b*, or seal assembly 102*b* to the valve 86*b*. The position of the valve 174 is controlled by the output of the tachometer so that at a predetermined speed, the cavity associated with seal 102*b* is vented and the control pressure $P_c$ applied to the cavity of seal 100*b*. This results in a reversal of compensating force as modulated by the control pressure $P_c$ to the rotor assembly 17*b* and maintains the net axial force within a predetermined range.

It will of course be apparent that alternative forms of control of the control pressure $P_c$ could be utilized, for example, a pressure control valve 86*b* for each vent line with appropriate electronic means to apply selectively the control signal 92*b* to one or the other of the pressure control valves 86*b*.

In each of the above embodiments it will be seen that by modulating the control pressure as axial forces on the rotor vary, the net forces acting on the rotor may be maintained within a predetermined range, thereby reducing the maximum forces to which the bearings supporting the rotor are subjected.

We claim:

1. A rotary fluid machine having a housing, a fluid duct extending through the housing, a rotor rotatably supported in the housing, a cavity formed in the housing and located to receive a shaft carried by said rotor, fluid supply means to supply fluid having a fluid pressure to said cavity, such that said fluid impinges upon said shaft, thereby placing an axial load upon said shaft and control means to control said fluid pressure in said cavity, wherein said control means include (a) a sensor which provides a signal corresponding to a parameter which is indicative of change in said axial load and (b) signal processing means, wherein said signal processing means contains a ratio bias module.

2. A rotary fluid machine according to claim 1 wherein a vent line is connected to said cavity and said control means controls said fluid pressure with said vent line.

3. A rotary fluid machine according to claim 1 wherein said fluid supply is derived from fluid in said duct downstream of said rotor.

4. A rotary fluid machine according to claim 1 wherein said rotor is rotating at rotational speed and said sensor is responsive to the rotational speed of said rotor.

5. A rotary fluid machine according to claim 1 wherein said rotational speed causes a pressure differential across said rotor and wherein said sensor is responsive to the pressure differential across said rotor.

6. A rotary fluid machine according to claim 1 wherein said ratio bias module is operable to vary the output of said control means for a given signal from said sensor.

7. A rotary fluid machine according to claim 6 wherein said ratio bias module is operable to vary the rate of change of output for a given change in input.

8. A rotary fluid machine according to claim 1 wherein said shaft is formed at one end of said rotor assembly.

9. A rotary fluid machine according to claim 1 wherein said shaft is formed intermediate the ends of said rotor assembly.

10. A rotary fluid machine according to claim 11 wherein said shaft passes through said cylinder and is sealed at opposite ends by a pair of seals having a different effective diameter.

11. A rotary fluid machine according to claim 12 wherein each of said seals is a dry gas seal.

12. A rotary fluid machine according to claim 1 wherein a plurality of piston and cylinders are formed at spaced locations on said rotor assembly, said control means including means to vary the control pressure in each of said cylinders.

13. A rotary fluid machine according to claim 12 wherein said control pressure may be varied in one of said cylinders independently of the other.

14. A rotary fluid machine according to claim 13 wherein said control means includes pressure regulating means and selection means to render said pressure regulating means operable upon one of said cylinders.

* * * * *